US007083331B2

(12) United States Patent
Nykoluk

(10) Patent No.: US 7,083,331 B2
(45) Date of Patent: Aug. 1, 2006

(54) STUFF SACK

(76) Inventor: Cory O. Nykoluk, 615 Crofton Cir. Ct., Ballwin, MO (US) 63021

( * ) Notice: Subject to any disclaimer, the term of this patent is extended or adjusted under 35 U.S.C. 154(b) by 294 days.

(21) Appl. No.: 10/637,974

(22) Filed: Aug. 8, 2003

(65) Prior Publication Data

US 2004/0081373 A1 Apr. 29, 2004

Related U.S. Application Data

(60) Provisional application No. 60/402,004, filed on Aug. 8, 2002.

(51) Int. Cl.
*B65D 30/00* (2006.01)

(52) U.S. Cl. ..... 383/2; 383/21; 383/75

(58) Field of Classification Search ..... 383/2, 383/16, 21, 75, 71, 72
See application file for complete search history.

(56) References Cited

U.S. PATENT DOCUMENTS 887,239 A * 5/1908 Ellis ..... 190/105
1,703,620 A * 2/1929 Hamilton ..... 73/427
2,080,252 A * 5/1937 Cook et al. ..... 383/90
3,842,977 A * 10/1974 Hollander ..... 206/407
4,267,868 A 5/1981 Lowe
4,466,124 A * 8/1984 Kirkham, Jr. ..... 383/2
4,604,765 A * 8/1986 Schultz ..... 5/413 AM
4,661,989 A 4/1987 Risby
5,125,547 A * 6/1992 Russell ..... 224/637
5,373,980 A * 12/1994 Rowell et al. ..... 224/240
5,894,780 A * 4/1999 Taniguchi ..... 71/9
6,089,752 A 7/2000 Moore
6,244,482 B1 * 6/2001 Gyarmaty ..... 224/318

* cited by examiner

*Primary Examiner*—Jes F. Pascua
(74) *Attorney, Agent, or Firm*—Polster, Lieder, Woodruff & Lucchesi L.C.

(57) ABSTRACT

In one aspect, the present disclosure provides a compressible stuff sack comprising a first sheet of flexible material having two opposite sides and a second sheet of flexible material having two opposite sides. The opposite sides of the first sheet are attached to corresponding opposite sides of the second sheet to form a body portion. Each attachment comprises a first seam adjacent edges of the first and second sheet and a second seam, spaced apart from the first seam. The two seams together create a flat portion that extends outwardly from an outer surface of the sack. The disclosure further provides an end portion attached to the body portion to form a cavity therewith. Also, a plurality of cinch straps are attached to the first and second sheets, each cinch strap having a corresponding opposite cinch strap that, when attached, allow the cinch straps to compress the contents of the sack. The disclosure also provides that the two sheets can be replaced with a single sheet.

8 Claims, 2 Drawing Sheets

STUFF SACK

CROSS-REFERENCE TO RELATED APPLICATIONS

The present application claims priority to U.S. Provisional Patent Application No. 60/402,004 filed Aug. 8, 2002.

FIELD OF THE INVENTION

The present invention relates to baggage. More specifically, it relates to an improved an improved stuff sack.

SUMMARY OF THE INVENTION

In one aspect, the present invention comprises a compressible stuff sack comprising a first sheet of flexible material having two opposite sides a second sheet of flexible material having two opposite sides. The opposite sides of the first sheet are attached to corresponding opposite sides of the second sheet to form a body portion. Each attachment comprising a first seam adjacent edges of the first and second sheet and a second, spaced apart seem from the first seam. The two seams together create a flat portion that extends outwardly from an outer surface of the sack. The invention further comprises an end portion attached to the body portion to form a cavity therewith. Also, a plurality of cinch straps are attached to the first and second sheets, each cinch strap having a corresponding opposite cinch strap that, when attached, allow the cinch straps to compress the contents of the sack. In another aspect of the present invention, the two sheets are replaced with a single sheet.

DESCRIPTION OF THE PREFERRED EMBODIMENT

Figure 1:
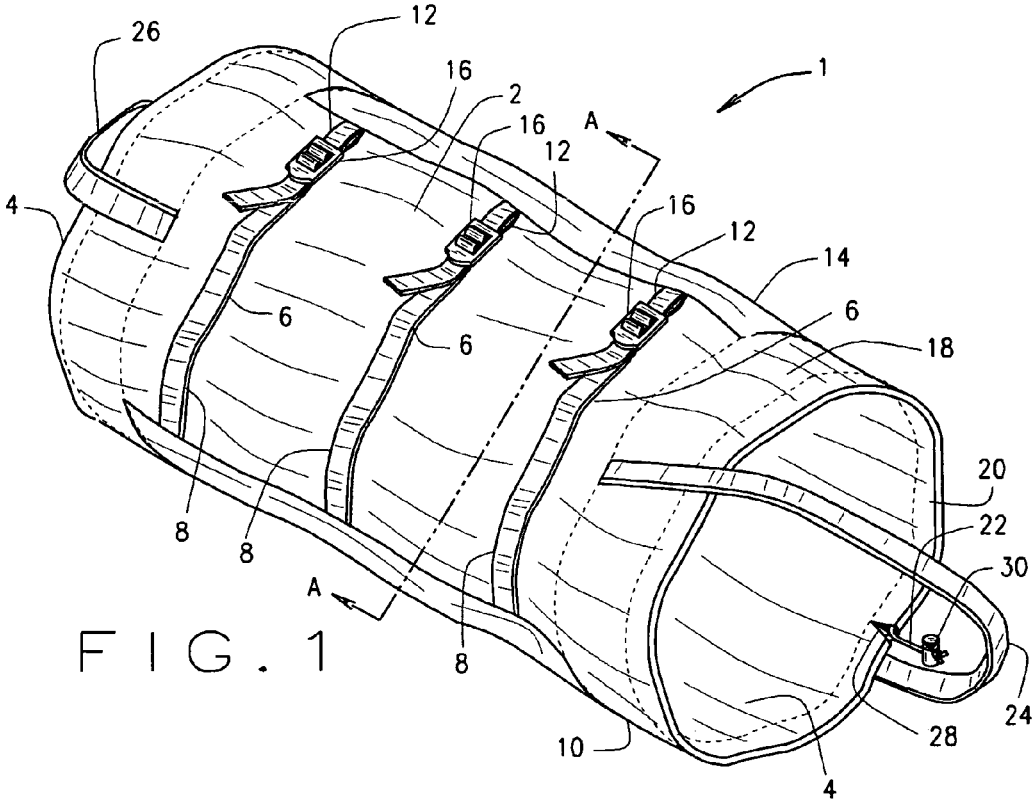
FIG. 1 is a perspective view of a stuff sack in an expanded state according to an embodiment of the present invention.

While the invention is susceptible of embodiment in many different forms, there is shown in the drawings and described in detail preferred embodiments of the invention. It is to be understood that the present disclosure is to be considered only as an example of the principles of the invention. This disclosure is not intended to limit the broad aspect of the invention to the illustrated embodiments. The scope of protection should only be limited by the claims issued in a subsequent utility patent application.

Figure 3:
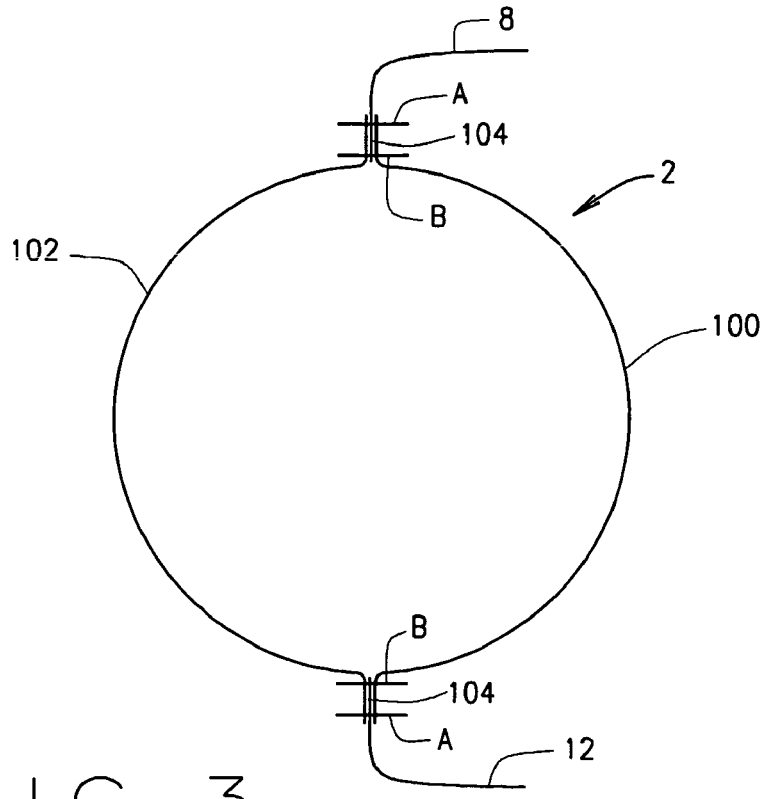
FIG. 3 is a plan view of a sectional end view of a stuff sack in an expanded state according to an embodiment of the present invention.

Referring to FIG. 1 there is shown a stuff sack 1 comprising a main body 2 and an end portion 4. As shown in FIG. 3, the main body comprises two flat pieces 100, 102 of material sewn together at least at seams A and B to create flat portions 104. For the purposes of the present application the term flat portion refers to an extend portion of material extending outwardly from an outside surface of a bag. The flat portion 104 is as a result of sewing two or more lines of stitching at a spaced apart distance. Referring to FIGS. 1 and 3, attached to the main body 2 are a plurality of cinch straps 6. The cinch straps 6 comprise a first end 8 attached to a first side 10 of the main body 2 and a second end 12 attached a second side 14 of the main body 2. The first and second ends 8, 12 are attached by sewing them into one or more of the lines of stitching of the seam attaching the flat pieces 100, 102. The second end 12 further comprises a strap slide 16 that is fixedly attached to the second end 12. The strap slide 16 is further threadingly attached to the first end 8 such that when the portion of the first end 8 that has been threaded through the strap slide 16 is pulled, it cannot be pulled back through the strap slide 16 merely by pulling on the portion of the first end 8 that has not been threaded through the strap slide 16. Rather, the threaded portion of the first end 8 must be pushed backward through the strap slide 16 and then the unthreaded portion pulled to remove that portion from the strap slide 16. Such strap slides are generally known in the art.

Also attached to the main body 2 is a closure portion 18. The closure portion 18 is sewn to the main body 2 and then doubled back upon itself to form a channel 20. Within the channel 20 is a drawcord 22. The ends of the drawcord 22 exit the channel 20 at an opening 28 and are held together by a drawcord retainer 30. Also sewn into the seam of the main body 2 and closure portion 18 is an end strap 24 which may be used for carrying the stuff sack 1. Furthermore, while not illustrated, the end strap 24 may comprise separate portions and a strap slide, as with the previously described cinch straps 6, in order to allow the end to be compressed, as described below. An end strap 26 may also be sewn into the seam attaching the end portion 4 to the main body 2. Again, while not illustrated, the end strap 26 may comprise separate portions and a strap slide, as with the previously described cinch straps 6, in order to allow the end to be compressed, as described below.

Figure 2:
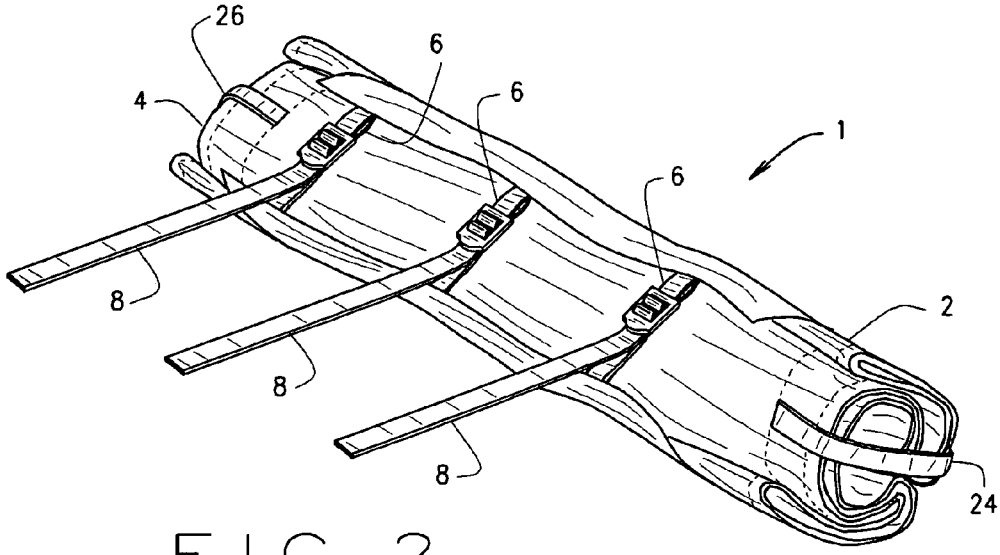
FIG. 2 is a perspective view of a stuff sack in a compressed state according to an embodiment of the present invention.

In use, the stuff sack 2 may be filled with compressible items such as clothing, a sleeping bag, pillows, etc. The drawcord 22 is then pulled and held with the retainer 30. Next, in order to make the items take less space, the stuff sack 2 is cinched down to compress the items. This is accomplished by pulling the first ends 8 of each of the plurality of cinch straps 6 through the strap slides 16, as shown in FIG. 2. As a result, air is expelled from the compressible item stored within the stuff sack 2 thus resulting in the space savings. Furthermore, if the end straps 24, 26 comprise slide straps they may also be tightened to provide a compressive force to the ends of the stuff sack 2.

Figure 4:
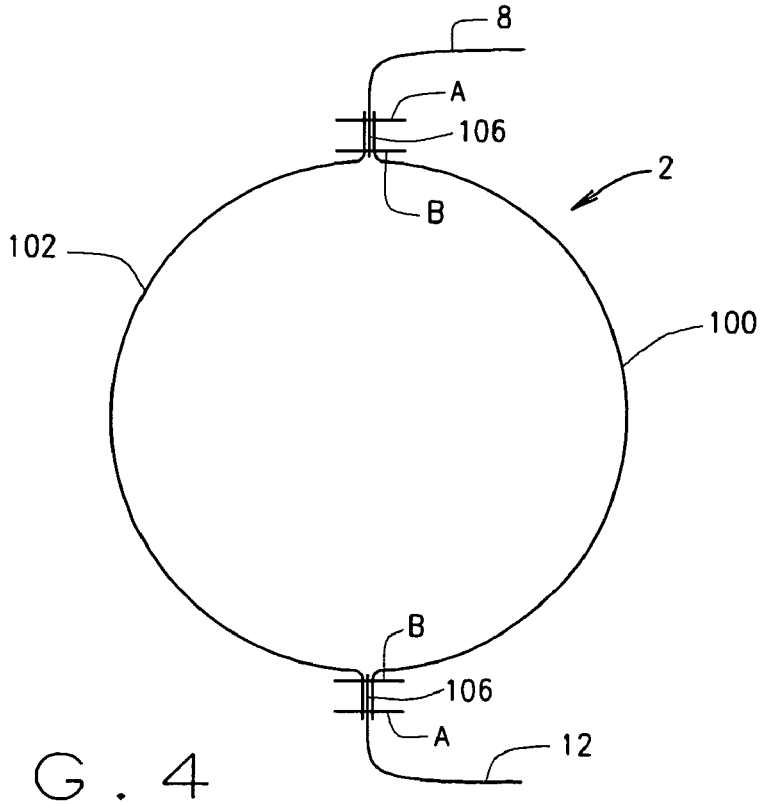
FIG. 4 is a plan view of a sectional end view of a stuff sack in an expanded state according to another embodiment of the present invention.

The present invention represents an advancement over the prior art in many ways. One significant enhancement is the flat portion 104 created by the main body 2. The flat portions provide a better means for attaching the cinch straps 6 to prevent their eventual pulling loose from the seams of the bag (in the case of the main body comprising two separate portions) or pulling loose from the bag (in the case of if the cinch straps being merely sewn to the surface of the bag). While the present invention contemplates and prefers the use of two separate portions 100, 102 to comprise the main body 2, the scope of the present invention comprises the main body of a single piece of material sewing doubled over portions of the main body in order to create the flat portions of the present invention (FIG. 4).

While the specific embodiments have been illustrated and described, numerous modifications come to mind without significantly departing from the spirit of the invention, and the scope of protection is only limited by the scope of the issued claims.

I claim:

1. A compressible stuff sack comprising:

a first sheet of flexible material having two opposite sides;

a second sheet of flexible material having two opposite sides, the opposite sides of the first sheet attached to corresponding opposite sides of the second sheet to form a body portion, each attachment comprising a first seam adjacent edges of the first and second sheet and a second seam, spaced apart from the first seam, the two seams together creating a flat portion that extends outwardly from an outer surface of the sack;

an end portion attached to the body portion to form a cavity therewith;

a plurality of cinch straps attached to the first and second sheets, each cinch strap having a corresponding opposite cinch strap that when attached allow the cinch straps to compress the contents of the sack.

2. The sack of claim 1 further comprising an end strap attached to the body portion and extending over the end portion.

3. The sack of claim 1 further comprising a closure portion attached to the body portion opposite the end portion, the closure portion comprising a channel having a drawcord disposed therein to selectively close the cavity formed by the end portion and the body portion.

4. The sack of claim 3 further comprising a second end strap attached to the body portion and extending over the end portion.

5. A compressible stuff sack comprising:

a sheet of flexible material having two opposite sides, the opposite sides attached to one another to form a body portion, the attachment comprising a first seam adjacent edges of the opposite sides and a second, spaced apart seam from the first seam, the two seams together creating a flat portion that extends outwardly from an outer surface of the sack;

a second flat portion formed by doubling over the sheet of material and placing a first seam near the edge of the doubled over sheet and placing a second seam adjacent to the first seam to form a second flat portion;

an end portion attached to the body portion to form a cavity therewith;

a plurality of cinch straps attached to the first and second seams, each cinch strap having a corresponding opposite cinch strap that when attached allows the cinch straps to compress the contents of the sack.

6. The sack of claim 5 further comprising an end strap attached to the body portion and extending over the end portion.

7. The sack of claim 6 further comprising a closure portion attached to the body portion opposite the end portion, the closure portion comprising a channel having a drawcord disposed therein to selectively close the cavity formed by the end portion and the body portion.

8. The sack of claim 7 further comprising a second end strap attached to the body portion and extending over the end portion.

* * * * *

UNITED STATES PATENT AND TRADEMARK OFFICE

CERTIFICATE OF CORRECTION

PATENT NO. : 7,083,331 B2
APPLICATION NO. : 10/637974
DATED : August 1, 2006
INVENTOR(S) : Cory O. Nykoluk It is certified that error appears in the above-identified patent and that said Letters Patent is hereby corrected as shown below:

Col. 3, Line 21
Replace " claim 1"
with --claim 2--

Signed and Sealed this

Twenty-second Day of May, 2007

JON W. DUDAS
*Director of the United States Patent and Trademark Office*